US006578239B2

(12) United States Patent
Hatch

(10) Patent No.: US 6,578,239 B2
(45) Date of Patent: Jun. 17, 2003

(54) LOW PROFILE LATCHABLE TIE

(76) Inventor: David A. Hatch, 35 Swanson Ct., Boxborough, MA (US) 01719

( * ) Notice: Subject to any disclaimer, the term of this patent is extended or adjusted under 35 U.S.C. 154(b) by 0 days.

(21) Appl. No.: 09/753,997

(22) Filed: Jan. 3, 2001

(65) Prior Publication Data

US 2002/0083559 A1 Jul. 4, 2002

(51) Int. Cl.[7] ..... B65D 63/00
(52) U.S. Cl. ..... 24/16 PB
(58) Field of Search ..... 24/16 R, 16 PB, 24/17 A, 17 PB, 17 AP; 248/74.1, 74.3; 224/164–177

(56) References Cited

U.S. PATENT DOCUMENTS

| | | | | | |
|---|---|---|---|---|---|
| 3,837,047 | A | * | 9/1974 | Bunnell | 24/16 PB |
| 3,886,630 | A | * | 6/1975 | Emery | 24/16 PB |
| 4,053,009 | A | * | 10/1977 | Edlin | 24/16 PB X |
| 4,287,644 | A | * | 9/1981 | Durand | 24/16 PB |
| 4,462,697 | A | * | 7/1984 | Thompson | 383/282 |
| 4,507,828 | A | * | 4/1985 | Furutsu | 24/16 PB |
| 5,293,669 | A | * | 3/1994 | Sampson | 24/16 PB |
| 5,745,957 | A | | 5/1998 | Khokhar et al. | |
| 5,818,375 | A | * | 10/1998 | Kastner | 24/16 PB |
| 5,890,265 | A | | 4/1999 | Tyton | |
| 5,911,367 | A | | 6/1999 | McInerney | |
| 6,076,234 | A | * | 6/2000 | Khokhar et al. | 24/16 PB |
| 6,253,421 | B1 | * | 7/2001 | Kraus | 24/16 PB |

FOREIGN PATENT DOCUMENTS

| | | | | |
|---|---|---|---|---|
| EP | 0 090 726 | A1 * | 3/1983 | 24/16 PB |

* cited by examiner

*Primary Examiner*—Robert J. Sandy
*Assistant Examiner*—Ruth C. Rodriguez
(74) *Attorney, Agent, or Firm*—John E. Toupal; Harold G. Jarcho

(57) ABSTRACT

A latchable tie including a flexible strap with an elongated section having spaced apart first teeth, a head end, a tail end, an upper surface and a lower surface; a head defining an outer end portion, an inner end portion joined to the strap, an outer opening in the outer end portion, an inner opening in the inner end portion, a channel extending between the outer opening and the inner opening and adapted to receive the tail end of the strap, a latch mechanism disposed in the channel and defining upwardly projecting longitudinally spaced apart second teeth for engaging the first teeth.

11 Claims, 7 Drawing Sheets

LOW PROFILE LATCHABLE TIE

BACKGROUND OF THE INVENTION

The present invention relates to a clamping device for various objects and, in particular, to a cable tie for constraining plural objects.

A number of fastening or clamping devices have been devised for a variety of purposes. For example, clamps are used with electrical systems to connect electric shielding or insulation about electric wires, especially about electrical connectors that receive current carrying conductors. Clamps used in such applications are typically referred to as cable ties.

Cable ties generally are of one-piece construction, consisting of a metal or plastic band with a buckle or head attached rigidly to one end of the band. The free end of the band feeds through the buckle to form a loop enclosing the electrical wires. The buckle typically contains locking teeth or tabs which interlock with slots or teeth in the band during band adjustment to retain a desired periphery of the band.

Disadvantages associated with prior cable ties result from the bulky, irregularly contained buckles typically used. Such buckles, in addition to being aesthetically displeasing, frequently inflict damage or injury when inadvertently contacted by objects or persons.

The object of this invention, therefore, is to provide a cable tie with an improved low profile and smoothly contoured head.

SUMMARY OF THE INVENTION

The invention is a latchable tie for tieing together plural objects and including a flexible strap with an elongated section defining a longitudinal axis and having a substantially uniform transverse width, a head end, a tail end, an upper surface and a lower surface; the lower surface defining a plurality of longitudinally spaced apart first teeth extending transversely to the axis; and a head defining an outer end portion, an inner end portion joined to the strap, an outer opening in the outer end portion, an inner opening in the inner end portion, a channel extending between the outer opening and the inner opening and adapted to receive the tail end of the strap, a bottom surface for contacting a portion of the objects being tied, an upwardly opening cavity disposed between the inner opening and the strap, and a cavity opening in the bottom surface and communicating vertically with the cavity; and the cavity and cavity opening each having a transverse width greater than the uniform transverse width of the strap. Also included is a latch mechanism disposed in the channel and defining upwardly projecting longitudinally spaced apart second teeth for engaging the first teeth. After insertion of the tail end of the strap through the channel in the head and severing an excess portion of the tail end, the cavity and cavity opening retain a remaining portion of the tail end.

According to one feature of the invention, the strap further includes a transition section joining the elongated section and the inner end portion of the head, the cavity and cavity opening are straddled by transversely spaced apart connector portions of the head, the connector portions extend between the inner opening and the transition section, and the transition section defines an inclined ramp surface partially defining the cavity and sloping upwardly from the cavity opening toward the strap. The ramp surface upwardly directs the tail end of the strap to facilitate severing thereof.

According to another feature of the invention, the elongated section has a uniform transverse cross-sectional area, and the connecting portions together define between the inner opening and an inner end of the cavity opening a combined minimum aligned transverse cross-sectional area substantially equal to or larger than the uniform cross-sectional area. The minimum cross-sectional area prevents the existence of a rupturable weak point in the strap.

According to an additional feature of the invention, the connector portions are tapered downwardly from the inner opening to the transition section. The tapered connector portions desirably enhance the flexibility of the head.

According to further features of the invention, the transition section has transverse cross-sectional areas diminishing between the head and the elongated section, and also defines transversely spaced apart side surfaces and upper and lower connecting surface portions extending therebetween with at least one of the connecting surface portions defining transverse recesses. The transition section provides a structurally sound connection between the head and strap and the recesses facilitate bending of the transition section to accommodate the curvature of a bundle being secured.

According to still other features of the invention, the head further defines a bottom opening in the bottom surface and communicating with the channel; and the latch consists of a pawl defining the second teeth, one end portion disposed in the bottom opening and projecting below the bottom surface, and an opposite end portion movably joined to the head so as to allow movement of said one end portion into the channel. In response to forces produced by contact of the one end portion with a portion of the objects being tied, the second teeth on the pawl are forced into tighter engagement with the first teeth on the strap.

According to yet another feature of the invention, the tie includes a guide joined to the outer end portion and defining an uncovered, guide surface aligned with the longitudinal axis and terminating at the outer opening; the guide surface having a length at least ¼ a length L of the channel The guide surface is arranged to guide the tail end of the strap though the outer opening during use of the tie.

According to another feature of the invention, the guide also includes wall portions straddling the guide surface and having inner surfaces joined to the guide surface by concave joint portions. The wall portions further facilitate insertion of the strap into the head and the joint portions enhance the structural strength of the guide to prevent rupture thereof.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 8:
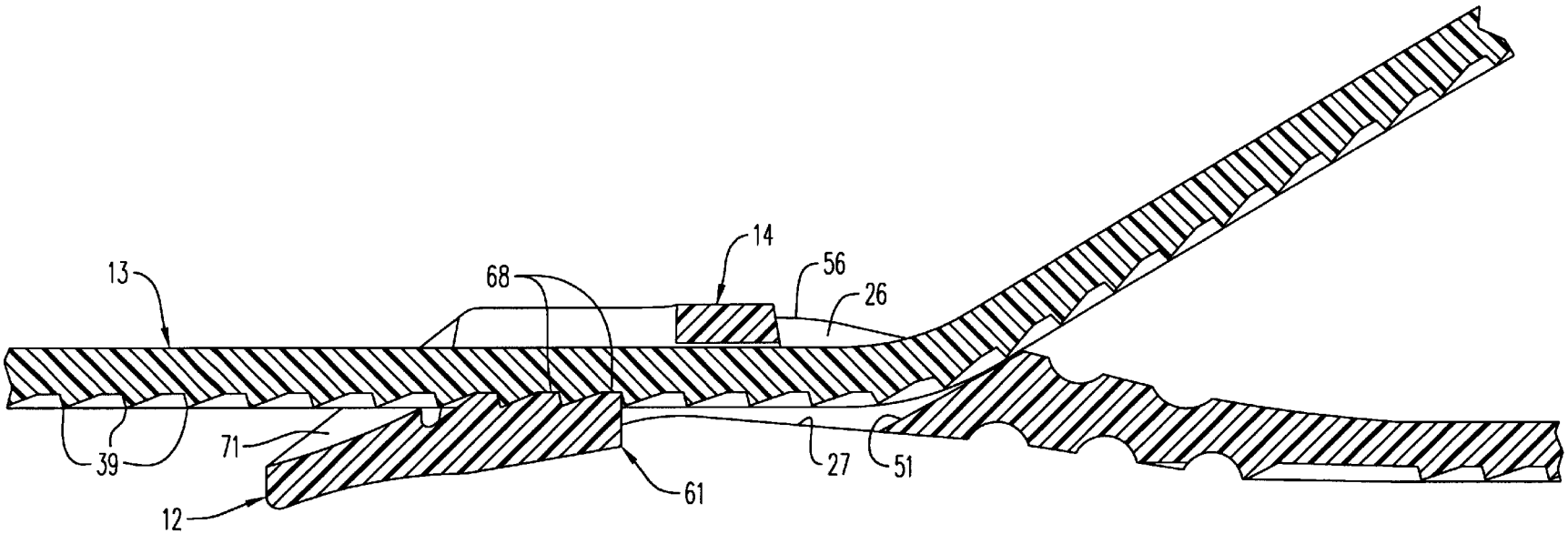
FIG. 8 is a partial longitudinal sectional view of the tie after insertion of the strap into the head.
Figure 9:
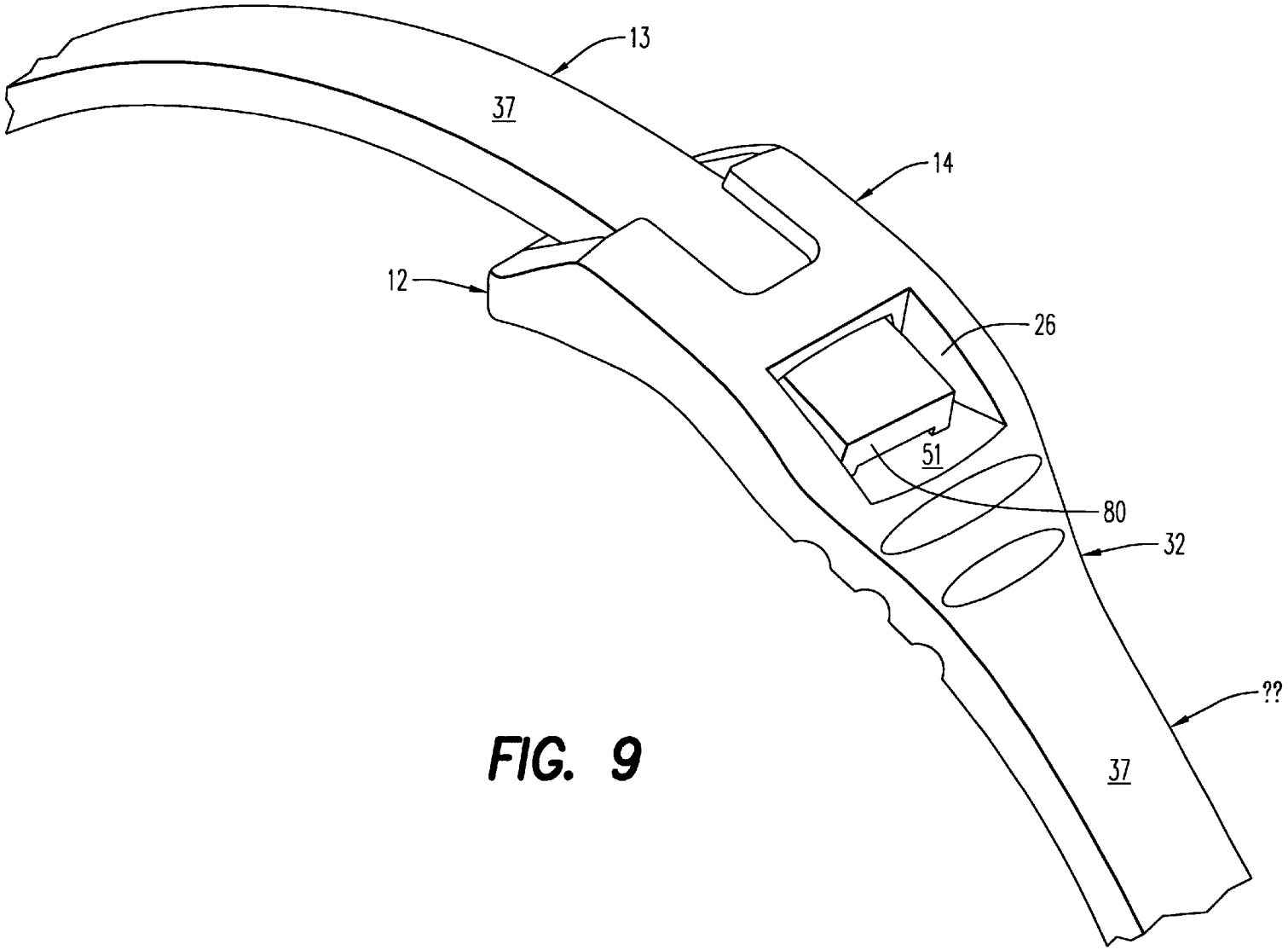
FIG. 9 is a partial top perspective view of the tie after insertion and termination of the excess strap portion.
Figure 10:
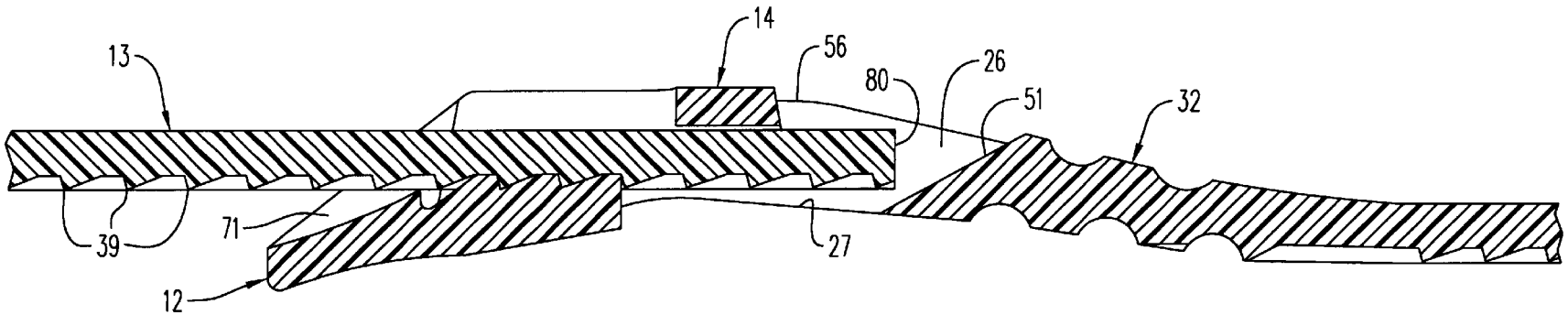
FIG. 10 is a sectional view taken longitudinally in FIG. 9.

A tie for securing together multiple articles such as cables is illustrated in FIGS. 1–10. Forming the tie his an insertion guide portion 12, a flexible strap 13, a head 14 joining the guide portion 12 and the strap 13, and a latch 15 attached to the head 14. The head 14 includes an outer end portion 18 joined to the guide portion 12 and an inner end portion 19 joined to the strap 13. Defined by the head 14 is a channel 21 for receiving the strap 13 (FIGS. 8–10) during use of the tie 11. The channel 21 extends between an outer opening 22 defined by the outer end portion 18 of the head 14 and an inner opening 23 defined byte inner end portion 19. Also formed by the inner end portion 19 forming the channel 21 are top wall 28 and side, wall portions (FIG. 5) of the head 14 which wall portions retain the strap 13 within the channel as shown in FIG. 8 of the bead 14 is an upwardly opening cavity 26 extending between the inner opening 23 and the strap 13. Communicating vertically with the cavity 26 and overlain thereby is another opening 27 also extending between the inner opening 23 and the strap 13.

Figure 1:
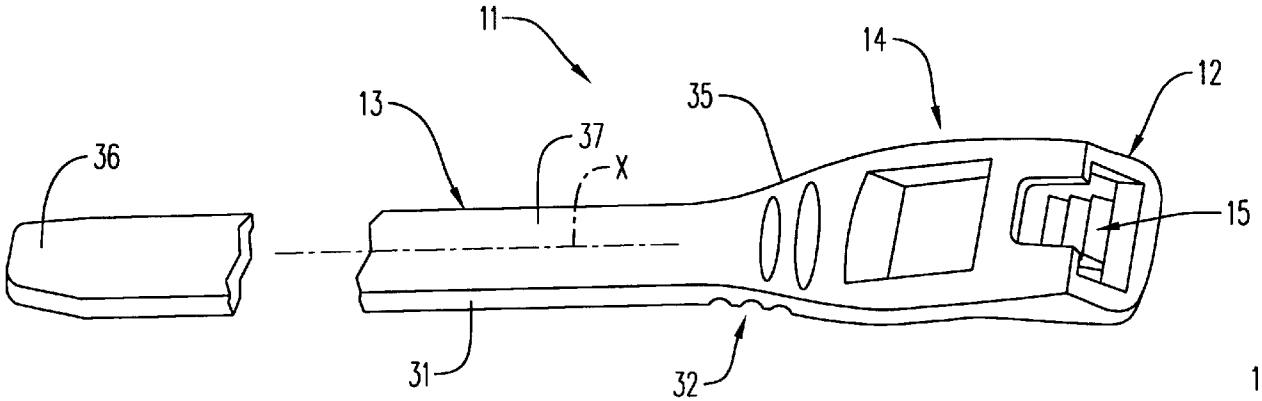
FIG. 1 is a top perspective view of a cable tie according to the invention.
Figure 2:
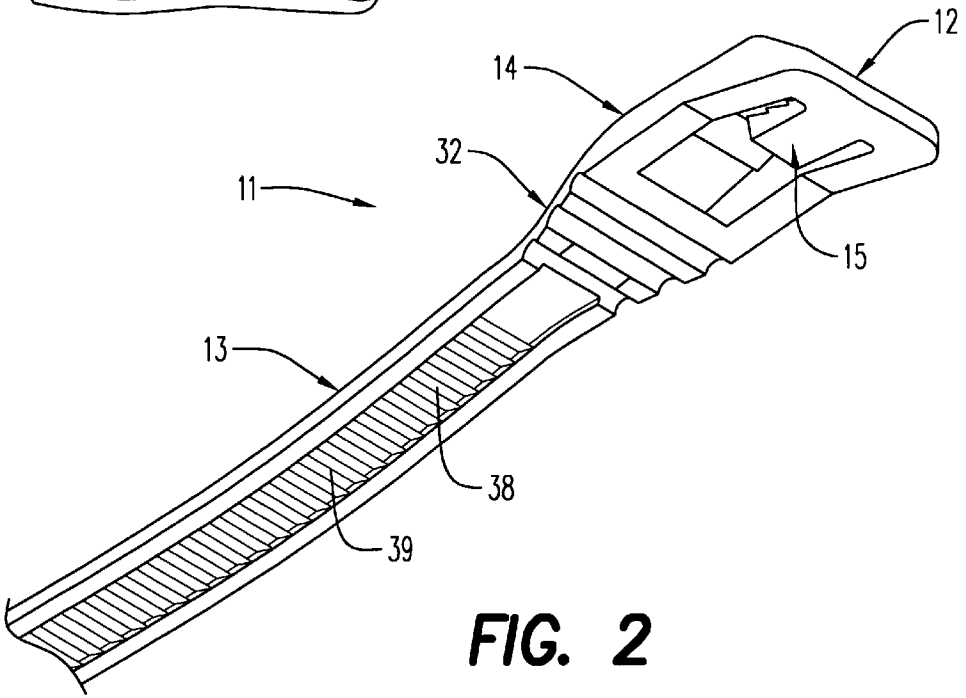
FIG. 2 is a bottom perspective view of the cable tie.
Figure 3:
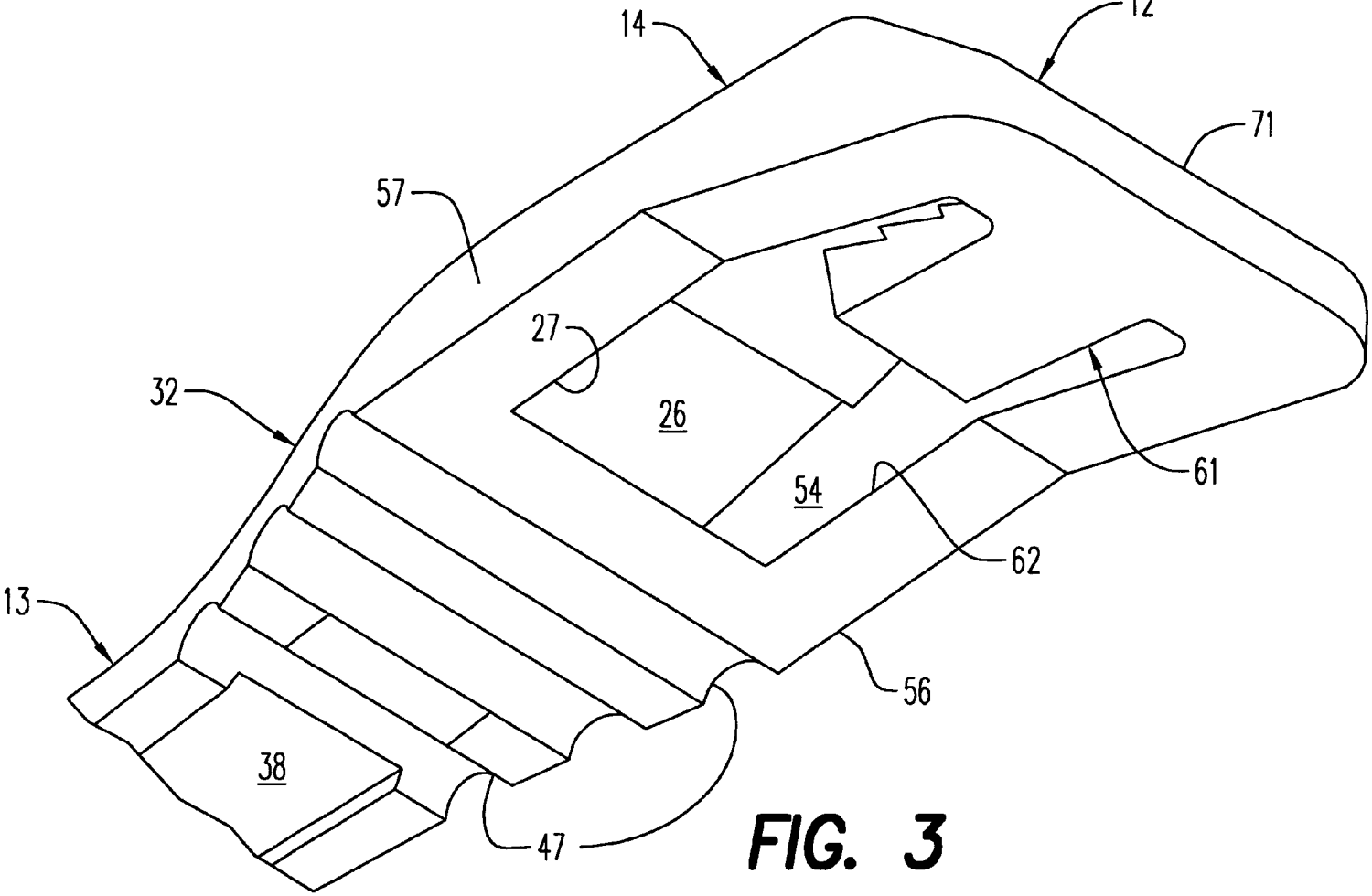
FIG. 3 is a bottom perspective view of a head portion of the cable tie.
Figure 4:
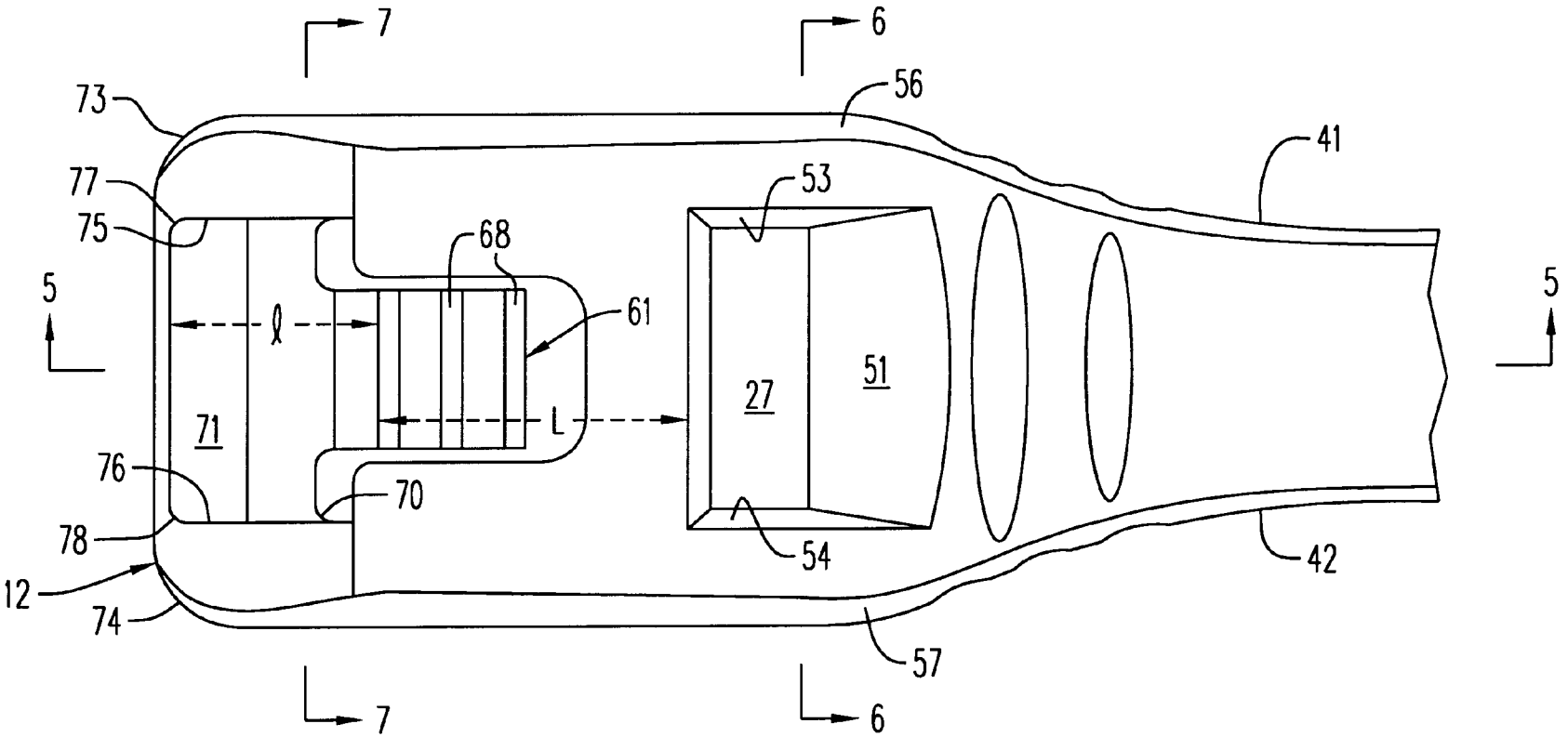
FIG. 4 is a top view of the head.
Figure 5:
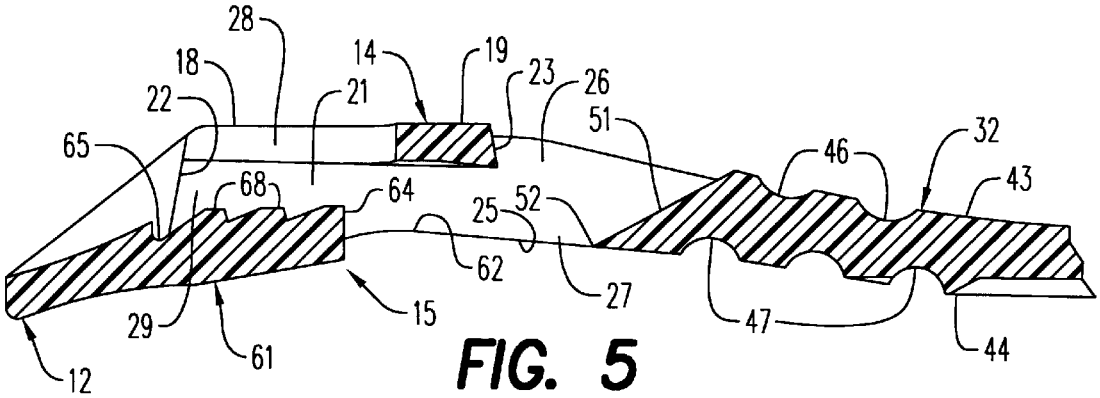
FIG. 5 is a longitudinal cross-section taken along lines 5—5 of FIG. 4.

The strap 13 includes an elongated section 31 with a longitudinal axis X and a transition section 32 joining the head 14 to the elongated section 31. Defined by the elongated section 31 is a head end 35 joined to the transition section 32 and a tail end 36 for insertion into the channel 21 through the outer opening 22 of the head 14. Also defined by the elongated section 31 are an upper surface 37 and a lower surface 38, a major length of which defines a plurality of longitudinally spaced apart first teeth 39 extending transversely to the axis X. The elongated section 31 has a uniform cross-section and corresponding uniform width. Defined by the transition section 32 are side surfaces 41 and 42 joined by an upper and lower connecting surfaces 43, 44 extending between the side surfaces 41, 42. A plurality of transversely extending groove recesses 46 are formed in the upper connecting surface 43 and a plurality of similar transversely extending groove recesses 47 are formed in the lower connecting surface 44. As shown in FIGS. 4 and 5 the transition section 32 has diminishing transverse cross-sections extending between the head 14 and the elongated section 31.

The cavity 26 is partially formed by an inclined ramp surface 51 at an inner end of the transition section 32. As shown in FIG. 5, the ramp surface 51 slopes upwardly from an inner edge 52 of the cavity opening 27 to the upper connecting surface 43 of the transition section 32 Further defining the cavity 26 are inner surfaces 53, 54 of, respectively, connector portions 56, 57 of the head 14 which connector portions extend between the inner opening 23 and the transition section 32. Preferably, both the cavity 26 and the another opening 27 have transverse widths substantially equal to the uniform width of the elongated strap section 31 so as to accommodate its passage after exiting the channel 21 of the head 14. As shown in FIG. 5, the connector portions 56, 57 taper downwardly from the inner end portion 19 of the head 14 to the ramp surface 51 so as to have therebetween diminishing transversely aligned cross-sectional areas. Preferably however, a minimum combined aligned transverse cross-sectional area of the connector portions 56, 57 anywhere between the inner opening 23 and the inner end of the another opening 27 is substantially equal to the uniform cross-sectional area of the elongated strap section 31 so as to conserve material and not establish a structural weakness subject to rupture by tensile forces applied to the tie 11. The combined transverse, cross-sectional area at the inner end of the another opening 27 is shown in Fit. 6.

The latch 15 is a flexible pawl 61 located in a bottom opening 62 in the bottom surface 25 of the head 14. One end portion 64 of the pawl 61 is disposed in the bottom opening 62 and projects below the bottom surface 25 while an opposite end 65 thereof is movably secured to the outer end portion 18 of the head 14. Defined in an upper surface of the pawl 61 are a plurality of longitudinally spaced, transversely extending second teeth 68 arranged to engage the first teeth 39 in response to insertion of the elongated section 31 of the strap 13 into the channel 21 through the outer opening 22. The pawl 61 is separated from the bottom surface 25 by longitudinally extending slots 69 each having an open outer end and an inner end closed by a radius joint 70 with the head 14.

Defined by the guide portion 12 is an uncovered guide surface 71 aligned with the axis X and terminating at the outer opening 22 of the head 14. Straddling the guide surface 71 are upwardly directed wall portions 73, 74. Inner surfaces 75, 76, respectively, of the wall portions 73, 74 are joined to the guide surface 71 by concave radius joint portions 77, 78 which strengthen the guide portion 12.

The guide surface 71 and wall portions 73, 74 direct movement of the tail end, 36 of the elongated strap 31 through the outer opening 22 of the head during insertion of the strap 13 into the channel 21. To facilitate that function, the guide surface 71 has a longitudinal length bit least ¼ the longitudinal length L of the channel 21 preferably at least ½ thereof as shown in FIG. 4. The minimum Length of the guide portion 12 also provides strength to prevent rupture during application of tensile stress to the tie 11. Also, as shown in FIG. 8, the maximum thickness of the head 14 is less than three times the uniform thickness of the strap 13 to provide the I tie 11 with a lower profile.

In use, the tie 11 is secured, for example, around a bundle of objects such as cables. During the securement process, the tail end 36 of the elongated strap 31 is passed, as shown in FIG. 8, sequentially through the outer opening 22, the channel 21, the inner opening 23 and the cavity 26. The tail end 36 then is pulled to tightly tension the tie 11 around the bundle (not shown). Insertion of the strap 13 through the channel 21 of the head 14 is facilitated by guidance of the tail end 36 along the guide surface 71. In a final tightened position of the tie 11, the second teeth 68 on the pawl 61 engage adjacent first teeth 39 on the lower surface 38 of the elongated strap section 31 so as to prevent reverse loosening movement of the strap 13 within the head 14. As the tie is tightened on the bundle, engagement of portions thereof with the pawl 61 exerts an upwardly directed force on a lower surface of the pawl 61 so as to more tightly engage the first and second teeth 39, 68. As the tail end 36 of the strap exits the inner opening 23, engagement with the ramp surface 51 produces upward movement of the exiting strap as shown in FIG. 8 to facilitate severing of the exited excess strap portion. After the excess strap portion is severed, the remaining terminal portion 80 of the flexible strap flexes downwardly into the cavity 26 (FIGS. 9 and 10) so as to eliminate undesirable projections from the head 14. Full reception of the terminal end 80 into the head is facilitated by the vertical communication between the cavity 26 and the cavity opening 27.

Obviously, many modifications and variations of the present invention are possible in light of the above teachings. It is to be understood, therefore, that the invention can be practiced otherwise than as specifically described.

What is claimed is:

1. A latchable tie for tieing together plural objects and comprising:

a flexible strap comprising an elongated section defining a longitudinal axis and having a substantially uniform transverse width, a head end, a tail end, an upper surface and a lower surface; said lower surface defining a plurality of longitudinally spaced apart first teeth extending transversely to said axis;

a head defining an outer end portion, an inner end portion joined to said outer end portion, an outer opening in said outer end portion, an inner opening in said inner end portion, a channel extending between said outer opening and said inner opening and defined by side and top walls adapted to receive and retain said strap, a bottom surface, an upwardly opening cavity disposed between said inner opening and said strap, and another opening in said bottom surface, said another opening overlain by and communicating vertically with said cavity; said cavity being partially defined by an inclined ramp surface sloping upwardly from an edge of said another opening toward said strap, and said edge being defined by the intersection of said cavity and said bottom surface; and therein said cavity and said another opening each have a transverse width greater than said uniform transverse width, and said ramp surface being shaped and arranged to engage said tail end and deflect said strap upwardly out of said cavity; and latch means disposed in said channel and defining upwardly projecting longitudinally spaced apart second teeth for engaging said first teeth.

2. A tie according to claim 1 wherein said strap further comprises a transition section joining said elongated section and said inner end portion of said head; said cavity and said another opening are straddled by transversely spaced apart connector portions of said head; and said connector portions extend between said inner opening and said transition section.

3. A tie according to claim 2 wherein said transition section defines said inclined ramp surface.

4. A tie according to claim 3 wherein said connecting portions together define between said inner opening and an inner end of said another opening a combined minimum aligned transverse cross-sectional area substantially equal to said uniform cross-sectional area.

5. A tie according to claim 4 wherein each of said connector portions is tapered downwardly from said inner opening to said transition section.

6. A tie according to claim 5 wherein said transition section has transverse cross-sectional areas diminishing between said head and said elongated section.

7. A tie according to claim 6 wherein said transition section defines transversely spaced apart side surfaces and upper and lower connecting surface portions extending therebetween, and at least one of said connecting surface portions defines a plurality of recesses.

8. A tie according to claim 1 wherein said elongated section has a given thickness and said head has a minimum thickness less than three times said given thickness.

9. A tie according to claim 1 wherein said head further defines a bottom opening in said bottom surface and communicating with said channel; and said pawl defines said second teeth, one end portion disposed in said bottom opening and projecting below said bottom surface, and an opposite end portion movably joined to said head so as to allow movement of said one end portion into said channel in response to forces proceed by contact of said one end portion with a portion of the objects being tied.

10. A tie according to claim 9 wherein said bottom surface is concave so as to conform to the objects.

11. A tie according to claim 9 wherein said bottom opening and said another opening are joined.

* * * * *

UNITED STATES PATENT AND TRADEMARK OFFICE

CERTIFICATE OF CORRECTION

PATENT NO. : 6,578,239 B2
DATED : June 17, 2003
INVENTOR(S) : David A. Hatch

It is certified that error appears in the above-identified patent and that said Letters Patent is hereby corrected as shown below:

Column 2,
Line 40, “though” should read -- through --

Column 3,
Line 9, “tie his an” should read -- tievis an --
Line 18, “byte” should read -- by the --
Line 22, “bead 14” should read -- head 14 --

Figure 6:
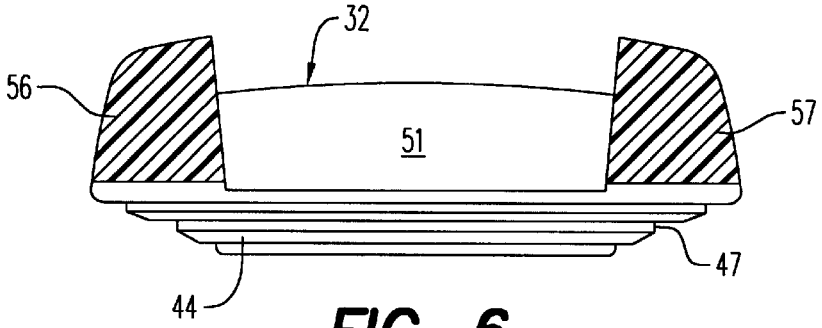
FIG. 6 is a transverse cross-sectional view taken along lines 6—6 of FIG. 4.
Figure 7:
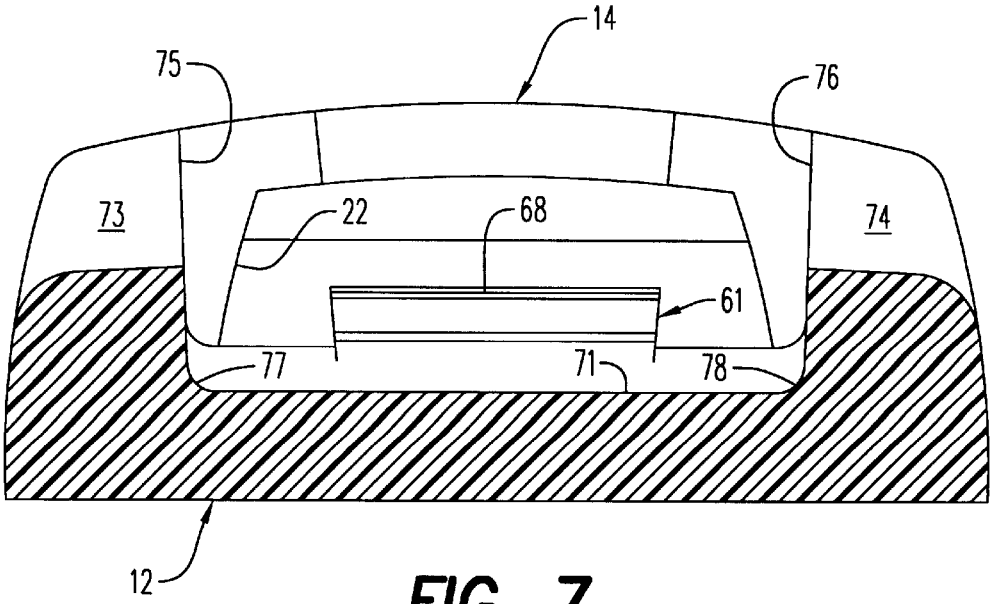
FIG. 7 is a transverse cross-sectional view taken along lines 7—7 of FIG. 4.

Column 4,
Line 6, “Fit. 6.” should read -- Fig. 6. --
Line 33, “bit least 1/4” should read -- at least 1/4 --
Line 40, take out “I”.
Line 40, “lower profile.” should read -- low profile. --

Signed and Sealed this

Twenty-eighth Day of October, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,578,239 B2
DATED : June 17, 2003
INVENTOR(S) : David A. Hatch

It is certified that error appears in the above-identified patent and that said Letters Patent is hereby corrected as shown below:

Column 3,
Line 9, "tie his an" should read -- tie 11 is an --.

Signed and Sealed this

Thirteenth Day of January, 2004

JON W. DUDAS
*Acting Director of the United States Patent and Trademark Office*